United States Patent [19]

Rogers

[11] Patent Number: 4,580,387

[45] Date of Patent: Apr. 8, 1986

[54] CORROSIVE RESISTANT GRID CONSTRUCTION FOR A SUSPENDED CEILING

[75] Inventor: David J. Rogers, Brampton, Canada

[73] Assignee: Crystaplex Plastics, Ltd., Mississauga, Canada

[21] Appl. No.: 680,708

[22] Filed: Dec. 12, 1984

[51] Int. Cl.[4] ..... E04B 5/55

[52] U.S. Cl. ..... 52/665; 52/489; 52/712

[58] Field of Search ..... 52/484, 489, 665, 712, 52/715

[56] References Cited

U.S. PATENT DOCUMENTS

| | | | |
|---|---|---|---|
| 3,089,570 | 5/1963 | O'Neil | 52/665 X |
| 3,785,110 | 1/1974 | Galloway et al. | 52/484 X |
| 3,815,309 | 6/1974 | Olsen | 52/489 |
| 3,911,638 | 10/1975 | Englund et al. | 52/489 |
| 4,027,454 | 6/1977 | Schuplin | 52/489 |
| 4,154,421 | 5/1979 | Suvitie | 52/484 X |
| 4,479,341 | 10/1984 | Schuplin | 52/489 X |

FOREIGN PATENT DOCUMENTS

| | | | |
|---|---|---|---|
| 555365 | 4/1958 | Canada . | |
| 762142 | 7/1967 | Canada . | |
| 857010 | 12/1970 | Canada . | |
| 959229 | 12/1974 | Canada . | |
| 1095682 | 2/1981 | Canada . | |
| 2143160 | 3/1973 | Fed. Rep. of Germany | 52/665 |
| 1502603 | 3/1978 | United Kingdom | 52/665 |

*Primary Examiner*—J. Karl Bell

*Attorney, Agent, or Firm*—Jones, Tullar & Cooper

[57] ABSTRACT

A clip is disclosed for joining fiberglass reinforced plastic grid members in order to provide a corrosive resistant frame work for a suspended ceiling. The grid members are of an inverted T configuration with an enlarged protrusion at the base of the T running the length of the member. The clip is resilient and generally U-shaped in cross-section with interiorly directed teeth which are able to engage and retain the protrusion on the grid members. Some clips are used to join grid members in end to end relation and others are provided with outwardly directed flanges and are used to hold ceiling panels in place.

3 Claims, 3 Drawing Figures

CORROSIVE RESISTANT GRID CONSTRUCTION FOR A SUSPENDED CEILING

This invention relates to a clip to join two elongated panel supporting members and, in a particular embodiment, to a grid of joined panel supporting members for a suspended ceiling which may assist in presenting a barrier to corrosive environments and may be adapted to withstand corrosive environments.

Grids for suspended ceiling assemblies are widely known in the building construction industry. Often the grid members are of an inverted "T" configuration—a flange extending normally from either side of the base of a web. With this configuration, the flanges of the grid members will support ceiling panels. Generally, the grids comprise parallel support members with cross members stretching between adjacent support members. Various methods have been devised to join the ends of the cross members to the support members. For example, in Canadian Patent No. 555,365 to Fotheringham, dated Apr. 1, 1958, the ends of each cross-member are provided with a tab extension, integral with one of the flanges of the cross-member. The end of a cross-member rests on the flange of a support member with the tab received through a slot in the web of the support member. The tab is bent against the side surface of the web in order to secure the cross member in position.

In Canadian Patent No. 1,095,682 issued Feb. 17, 1981 to Balinski, the ends of the cross-member webs are provided with tongue extensions which are received in slots in the supporting members. The cross-members are dimensioned so as to provide an expansion gap between the ends of each cross-member and the support members to which each cross-member is joined. Only the tongues extend to and beyond the flanges of the support members.

In both of these prior art patents, the grid members are metallic. While these grid constructions are satisfactory for certain applications, they are not satisfactory for use in a corrosive environment wherein metal grid members would deteriorate. Further, in order to apply the joint taught in Canadian Patent 555,365 to non-corrosive grid members, a non-corrosive material would have to be found which is sufficiently malleable to allow the tab at the ends of the cross-members to be bent. Further yet, although replacing the metal grid members of Canadian Patent No. 1,095,682 with non-corrosive members would provide a ceiling panel supporting grid construction, the grid construction would not present a satisfactory barrier to a corrosive environment due to the gaps between the cross-members and support members.

Consequently, there remains a need for a means to join grid members which may not only be used in non-corrosive environments but which may also be adapted for use in corrosive environments and which results in a low cost of construction. The present invention seeks to provide such a joint.

Briefly stated, the present invention relates to a suspended ceiling grid comprising a plurality of members comprising elongated main members and cross members having a ceiling panel supporting flange extending outwardly from either side of the base of a web, the free end of the web terminating in a protrusion, the members being arranged in a grid. The invention is the improvement comprising:

a plurality of resilient clips joining members in end to end relation, the clips being generally U-shaped in cross-section and having a plurality of opposed pairs of inwardly directed teeth, one of the pairs of teeth of each clip retaining the protrusions of neighbouring end to end facing members.

In drawings which illustrate preferred embodiments of the invention:

Figure 1:
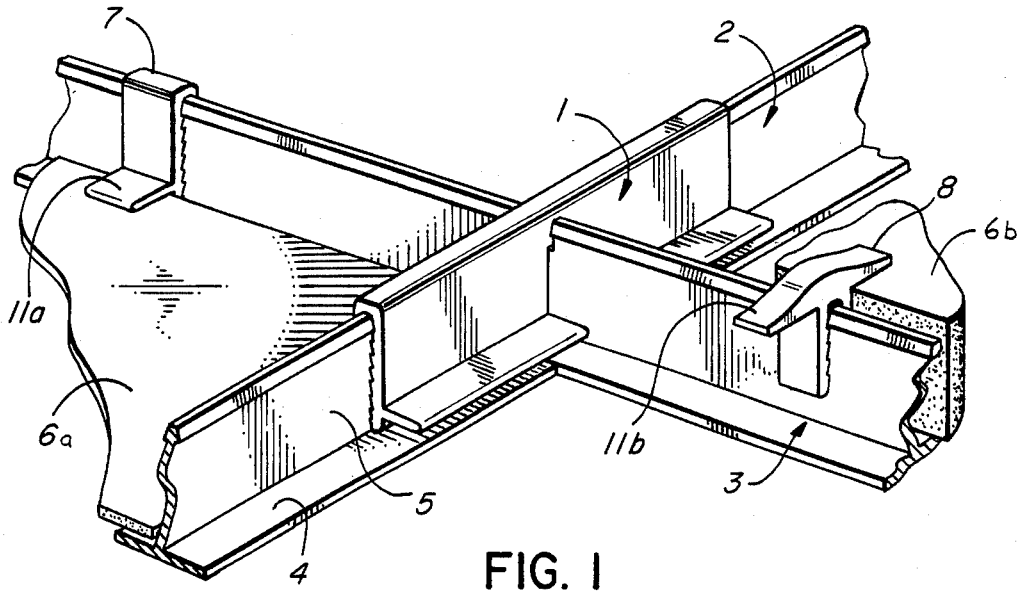
FIG. 1 is a cutaway perspective view of a portion of a ceiling grid system which illustrates one embodiment.

Referring now to FIG. 1, a portion of two cross members 2 are shown joined by the junction clip 1 of this invention to either side of main member 3. The main and cross members are formed generally in the known inverted T configuration—that is, a flange 4 extends normally from either side of the base of a web 5. The flanges 4 are able to support ceiling panels 6. Thus, the main and cross members are ceiling panel supporting members.

Ceiling panels may be held in place atop flanges 4 with the assistance of hold down clips 7 or 8, hold down clip 7 being utilized with thin ceiling panels, such as illustrated at 6*a*, and hold down clip 8 being utilized with thick panels, such as illustrated at 6*b*. For a better understanding of the system, reference is made is FIG. 2.

The body of junction clip 1 is generally U-shaped in cross-section. However, the arms 9 of the body of the clip are in greater proximity at the open end of the clip. The clip is formed of a resilient material so that arms 9 may flex to some extent. The interior surface of each arm 9 of the junction clip is formed with internally directed teeth 10 which run the length of the clip. The teeth have a saw tooth configuration. The teeth on each arm 9 form opposed pairs of teeth which co-operate in the manner described hereinbelow in order to retain ceiling panel supporting members. Junction clip 1 is also formed with a medial notch 12 or slot 12 extending upwardly from the lower end of the clip. Optional hold down flanges 11 extend outwardly from the clip body near the open end of the clip.

While the ceiling panel supporting members are formed in a generally inverted T configuration, the free or top end of the web 5 of each member terminates in a protrusion or bead 13 which runs the length of the member. Protrusion 13 has, in cross-section, the form of a truncated triangle.

By virtue of the protrusion 13, junction clip 1 may join two cross-members 2 which are resting on the flanges of main member 3 in end to end relation on opposite sides of the main member web. Cross members 2 are positioned on main member 3 in line with a notch 14 extending into the free end of the web of main member 3. The notch 12 of clip 1 is then registered with notch 14 and the clip pushed over the protrusion 13 of the cross members and onto the webs 5 of the cross members. As the junction clip is pushed over the protrusions, the internal surfaces of the clip engage the protrusions 13 and the arms 9 of the clip flex outwardly and then snap inwardly as each opposed pair of teeth pass the protrusion. After one pair of teeth passes the protrusion and the arms of the clip snap inwardly, the protrusion is wedged between the back surfaces of that pair of teeth and the inwardly inclined surfaces of the next pair of teeth. Junction clip 1 is pushed onto the cross members until the protrusions of the two cross members are wedged between the back surfaces of the last pair of teeth and the interior surface of the clip at the closed end of the clip. Notches 12 and 14 co-operate to permit the junction clip to be pushed onto the cross members to this extent.

Figure 3:
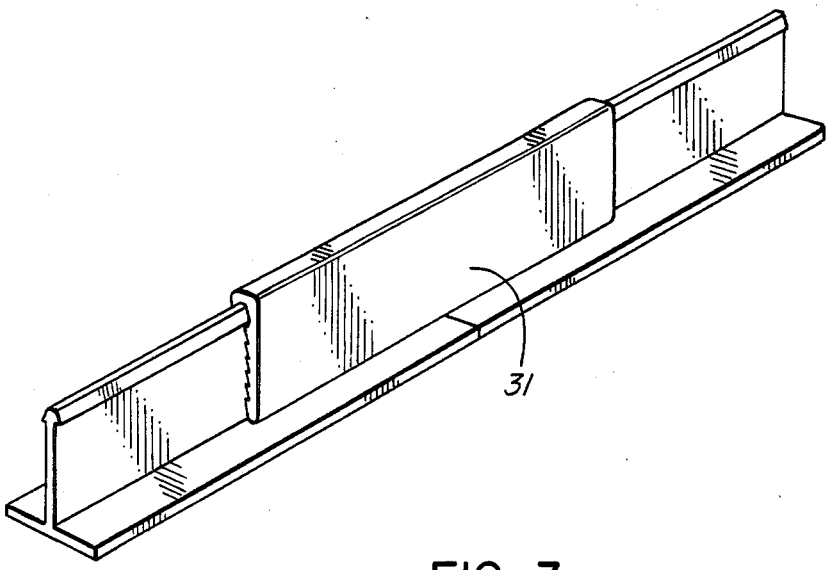
FIG. 3 is a perspective view of 2 grid members joined end to end by a clip according to another embodiment.

As will be apparent, junction clip 1 could also join two grid members in end to end relation without an intervening main member. Modified clip 31, illustrated in FIG. 3, performs this function. Clip 31 is identical to junction clip 1 save that it omits notch 12 and the hold down flanges 11.

Returning to FIG. 1, once clip 1 is in place, hold down flanges 11 overlie ceiling panel 6*a* and assist in holding this panel in place atop flanges 4 of the grid members. Other clips, namely hold down clips 7 and 8, are solely for the purpose of assisting in holding ceiling panels in place. Like clip 1, these clips are resilient and have protrusion retaining teeth. The hold down flanges 11*a* of clip 7 are positioned near the open end of the clip so that the clip is useful in assisting in holding thin ceiling panels in place. On the other hand, the hold down flanges 11*b* of clip 8 are positioned near the closed end of the clip in order that the clip 8 may assist in holding thicker ceiling panels in place. Hold down clips may be pushed onto grid members until their hold down flanges abut these ceiling panels. With thicker ceiling panels, clip 1 may be formed with hold down flanges near the closed end of the clip or the hold flanges may be omitted entirely.

While only two joints have been described, it will be apparent that a grid of main members and cross members may be formed with junction clips 1 joining the cross members at either side of their junction with each main member, and clip 31 joining grid members where the span between supports is greater than the length of a single grid member. The main members are provided with regularly spaced sequence of upwardly opening notches 14 at each desired cross member junction. Hold down clips 7 or 8 are employed as required to retain ceiling panels in place.

Ceiling panel supporting members which run along the wall may be L-shaped. A completed grid of members may be suspended with wires which pass through holes (not illustrated) in the main members.

Figure 2:
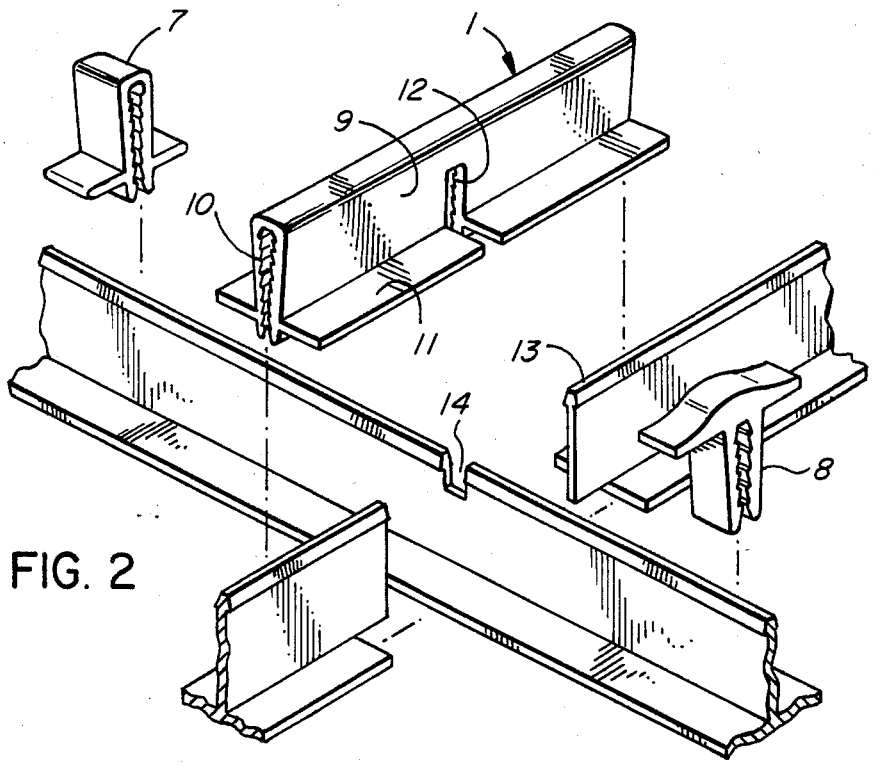
FIG. 2 is an exploded view of the ceiling grid members and clips of FIG. 1.

The suspended ceiling grid made in accordance with this invention, once supplied with ceiling panels, will present a barrier to corrosive environments of the following reasons. With reference to FIGS. 1 and 2, it is seen that the flanges 4 at the ends of the cross members 2 are cut back for a distance approximately equal to the width of the flange of the main member 3. Because of this, the flangeless edge of the cross member web 5 opposite protrusion 13 may rest upon the flange of the main member 3 with the end of the cross member web 5 abutting the side of the web of the main member and the end of the flange of the cross member abutting the edge of the flange of the main member. As the end of the cross members abut the side of the main members, a grid of members may be made which will assist in presenting a barrier to a corrosive environment. Also, with this arrangement, the surfaces of the flanges 4 of the cross member and main member will be flush. This permits ceiling panels in a suspended ceiling system made in accordance with this invention to abut the flanges of supporting ceiling panel supporting members along the entire periphery of the ceiling panel. This, in combination with the feature of the ends of the cross members abutting the main members, results in a suspended ceiling system which presents a barrier to a corrosive environment. In order that parts of the grid system may withstand such environments, the grid members may be formed of fiberglass reinforced plastic and the clips formed of plastic.

The grid members may be formed by protruding and the flanges 5 of the cross members cut back by machining. The web of the main members may be perforated for the reception of suspension wires by a punch and an aquafoam rivet may be received in each perforation.

The embodiments of the invention in which an exclusive property or privilege is claimed are defined as follows:

1. In a suspended ceiling system comprising elongated main members and cross members each having a ceiling panel supporting flange extending outwardly from either side of the base of a web, the free end of the web terminating in a bead, said members being arranged in a grid, the improvement comprising:

a plurality of resilient clips joining the cross members to either side of the main members, said clip being generally U-shaped in cross section and having a plurality of opposed pairs of inwardly directed teeth, one of said pairs of teeth of each clip engaging the bead of a cross member abutting a main member;

each main member having a regularly spaced sequence of upwardly opening notches in the bead and each resilient clip having a medial slot extending upwardly from the lower end of the clip, the portion of each clip above the slot being received in the corresponding notch whereby the cross members are restricted from movement in the longitudinal direction of the main members.

2. In the suspended ceiling system of claim 1, the further improvement wherein said main and cross members and said first and second plurality of clips are formed of corrosive resistant materials.

3. A suspended ceiling system comprising:

a plurality of members comprising elongated main members and cross members each having a ceiling supporting flange extending outwardly from both sides of the base of a web, the free end of the web terminating in a bead, said plurality of members being arranged in a grid;

a plurality of ceiling panels supported by said ceiling panel supporting flanges;

a plurality of elongated resilient clips extending along and joining pairs of said cross members in end to end relation on opposite sides of the web of a main member each said resilient clip spanning the main member and securing said cross members thereto, each of said resilient clips being generally U-shaped in cross section and having a medial slot extending up from the open end of the clip and receiving the web portion of the main member, said resilient clip further having a plurality of opposed pairs of inwardly directed teeth, one of said pairs of teeth of each clip retaining the beads of a pair of cross members;

upwardly opening notches in the webs and beads of said main members located at the junctions of said cross members with said main members, said notches engaging the ends of said medial slots in corresponding clips to restrict the cross members against movement along said main members.

* * * * *

UNITED STATES PATENT AND TRADEMARK OFFICE

CERTIFICATE OF CORRECTION

PATENT NO. : 4,580,387

DATED : April 8, 1986

INVENTOR(S) : David J. Rogers

It is certified that error appears in the above-identified patent and that said Letters Patent is hereby corrected as shown below:

Claim 3, line 4, before "supporting," insert --panel--.

Signed and Sealed this

*Nineteenth* Day of *August 1986*

[SEAL]

*Attest:*

DONALD J. QUIGG

*Attesting Officer*

*Commissioner of Patents and Trademarks*